US006655106B1

(12) United States Patent
Sucre F.

(10) Patent No.: US 6,655,106 B1
(45) Date of Patent: Dec. 2, 2003

(54) CORNER STUDS FOR PREFABRICATED BUILDING SYSTEMS

(76) Inventor: Alfredo J. Sucre F., Qta. #428, Av. Central, Urb. La Lagunita Country Club, El Hatillo-Caracas (VE)

( * ) Notice: Subject to any disclaimer, the term of this patent is extended or adjusted under 35 U.S.C. 154(b) by 0 days.

(21) Appl. No.: 09/638,060

(22) Filed: Aug. 11, 2000

Related U.S. Application Data

(60) Provisional application No. 60/148,883, filed on Aug. 13, 1999.

(51) Int. Cl.[7] ..... E04C 3/30

(52) U.S. Cl. ..... 52/733.2; 52/481.1; 52/281; 52/732.3; 52/731.5; 52/731.7; 52/731.9; 52/800.12

(58) Field of Search ..... 52/732.1, 239, 52/270, 272, 280, 282.2, 281, 584.1, 587.1, 580, 732.3, 733.2, 481.1, 731.5, 731.7, 731.9, 800.12, 81.2, 81.3

(56) References Cited

U.S. PATENT DOCUMENTS

| | | | | |
|---|---|---|---|---|
| 2,076,728 A | * | 4/1937 | Keller | 52/601 |
| 2,809,404 A | | 10/1957 | Hinds | |
| 3,327,440 A | | 6/1967 | Watkins | |
| 3,736,035 A | | 5/1973 | Brown et al. | |
| 3,738,083 A | | 6/1973 | Shimano | |
| 3,768,222 A | | 10/1973 | Birum, Jr. | |
| 3,774,362 A | | 11/1973 | Matuschek et al. | |
| 3,820,229 A | | 6/1974 | Verholt | |
| 4,030,262 A | | 6/1977 | Dean | |
| 4,104,837 A | | 8/1978 | Naito | |
| 4,186,539 A | | 2/1980 | Harmon et al. | |
| 4,437,285 A | * | 3/1984 | Anderson et al. | 52/481 |
| 4,493,172 A | | 1/1985 | Jones | |
| 4,967,531 A | | 11/1990 | Giles et al. | |
| 4,989,386 A | | 2/1991 | Collis | |
| 5,009,042 A | | 4/1991 | Sacco et al. | |
| 5,063,722 A | * | 11/1991 | Hohmann | 52/410 |
| 5,097,643 A | | 3/1992 | Wittler | |
| 5,105,594 A | | 4/1992 | Kirchner | |

(List continued on next page.)

FOREIGN PATENT DOCUMENTS

| | | |
|---|---|---|
| EP | 0 051 319 | 5/1982 |
| EP | 0 089 443 | 9/1983 |

(List continued on next page.)

OTHER PUBLICATIONS

Panelized Brick Wall System for Architectural Applications by Bonitz Mfg./US Brick, Inc.—brochure sent to applicant by US Brick/Real Brick on Aug. 21, 1990.

R–Control Panel Building System—From 1991 Sweet's Homebuilding/Remodeling Catalog File, McGraw Hill.

Wall Systems by STEELOX including TW–100 Wall Panel and Design–Line Wall Panel—brochure sent to applicant on Jul. 27, 1993.

*Primary Examiner*—Carl D. Friedman
*Assistant Examiner*—Chi Q. Nguyen
(74) *Attorney, Agent, or Firm*—Fish & Neave; Garry J. Tuma; Stuart W. Yothers

(57) ABSTRACT

Corner studs for prefabricated building systems are presented. The corner studs have an angled side that when interconnected with the angled side of another such stud forms a complete, structurally sound corner. The studs can be fabricated such that they can form corners of various angles. For example, corner studs can be fabricated to form corners of substantially 90°, 108° (e.g., used in pentagonal structures), or 120° (e.g., used in hexagonal structures). Galvanized metal, stainless steel, wood, suitable plastics, and other suitable materials can be used to fabricate the studs. The corner studs can have solid or hollow interiors with various cross-sectional configurations.

19 Claims, 7 Drawing Sheets

U.S. PATENT DOCUMENTS

| | | | | | |
|---|---|---|---|---|---|
| 5,247,773 | A | | 9/1993 | Weir | |
| 5,261,205 | A | | 11/1993 | Sandor | |
| 5,271,687 | A | | 12/1993 | Holka et al. | |
| 5,313,751 | A | | 5/1994 | Wittler | |
| 5,486,391 | A | | 1/1996 | Tyner | |
| 5,642,594 | A | * | 7/1997 | Sucre F | 52/270 |

FOREIGN PATENT DOCUMENTS

| | | | | |
|---|---|---|---|---|
| EP | 0 121 031 | | 10/1984 | |
| EP | 0 210 116 | | 1/1987 | |
| EP | 0 235 033 | | 9/1987 | |
| ES | 337032 | | 1/1968 | |
| ES | 335441 | | 2/1968 | |
| ES | 333078 | | 3/1968 | |
| ES | 351465 | | 12/1969 | |
| ES | 411974 | | 1/1976 | |
| ES | 429404 | | 1/1977 | |
| ES | 435057 | | 1/1977 | |
| ES | 243836 | | 11/1979 | |
| ES | 487268 | | 3/1981 | |
| ES | 497850 | | 5/1982 | |
| ES | 506457 | | 9/1982 | |
| ES | 537352 | | 6/1986 | |
| ES | 360591 | | 11/1986 | |
| ES | 9101239 | | 12/1991 | |
| JP | 5-222786 | * | 4/1992 | E04B/2/56 |
| VE | 83-1775 | | 10/1983 | |
| VE | 89-0790 | | 5/1989 | |
| VE | 90-1657 | | 10/1990 | |
| WO | 86/00947 | | 2/1986 | |
| WO | 86/01242 | | 2/1986 | |
| WO | WO 94/10403 | * | 11/1993 | E04B/2/72 |

* cited by examiner

CORNER STUDS FOR PREFABRICATED BUILDING SYSTEMS

CROSS REFERENCE TO RELATED APPLICATION

This claims the benefit of U.S. Provisional Application No. 60/148,883, filed Aug. 13, 1999.

BACKGROUND OF THE INVENTION

This invention relates to corner studs for prefabricated building systems. More particularly, this invention relates to corner studs that directly interconnect and align with other structural components to form complete, structurally sound corners.

The construction industry has attempted to provide simple economical building systems that can be used to construct stable habitable structures in the shortest possible time using the least possible amount of construction materials and labor—while also attempting to provide these systems with as much freedom of design as possible. One such known building system includes generally rectangular structural wall panels that join together to form a desired structure. A disadvantage of such a system, however, is that direct connections between the vertical edges of adjoining panels cannot be made at corners. This results in the central alignment planes of the panels (i.e., the vertical plane cutting across the center of the panel from the middle of one vertical edge to the middle of the opposite vertical edge) not meeting where the panels intersect. Accordingly, a complete and regular alignment of the central alignment planes cannot be maintained throughout the structure, causing a disruption in the structure's geometric order. This can result in nonuniform distribution and transmission of loads and forces. Moreover, when central alignment planes do not meet at panel intersections, panel dimensions cannot be easily regularized (if at all), which can complicate the on-site assembly process.

Another disadvantage of this known building system is that the rectangular panels cannot be easily used, if at all, to form structurally sound non-90° corners, as is common in many architecturally aesthetic structures. To form such non-90° corners, other construction methods and materials may have to be used, causing a loss of uniformity and homogeneity while increasing construction time and costs.

Another known prefabricated building system includes wall panels that have vertical studs with an edge that includes two converging sides ending at a vertex. The vertex is pointed away from the parallel sides of the stud. While corners formed with such interconnected wall panels maintain alignment of central alignment planes, the corners are incomplete (e.g., not squared). Thus additional materials, labor, and time are often required to square the corner. Moreover, this system also cannot be easily used, if at all, to form complete, structurally sound non-90° corners.

In view of the foregoing, it would be desirable to provide a corner stud that readily maintains alignment of central alignment planes and that readily interconnects to form complete, structurally sound corners of various angles.

It would also be desirable to provide such a corner stud that can be used to form structural wall panels of a prefabricated building system.

SUMMARY OF THE INVENTION

It is an object of this invention to provide a corner stud that readily maintains alignment of central alignment planes and that readily interconnects to form complete, structurally sound corners of various angles.

It is also an object of this invention to provide such a corner stud that can be used to form structural wall panels of a prefabricated building system.

In accordance with this invention, a corner stud is provided that includes two substantially parallel sides spaced a distance apart, each side having a first end and a second end. A third side connects the two parallel sides at their first ends, which are juxtaposed. The third side also forms an angle with each of the two parallel sides, neither angle equaling 90°. Corner studs of the present invention can be fabricated with different angles to form corners of different angles. The corner studs also can be fabricated with either a solid or hollow interior. Hollow interior studs can include end segments connected to the second ends of the parallel sides. Studs of the present invention can be preferably used to form several types of structural wall panels for use in prefabricated building systems.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

The present invention provides corner studs that can be used to form complete, structurally sound corners of various angles for stable habitable structures. These corner studs maintain alignment of central alignment planes and can be preferably used in the prefabricated building system disclosed in Sucre F U.S. Pat. No. 5,642,594, issued Jul. 1, 1997, which is incorporated by reference herein in its entirety.

Figure 1:
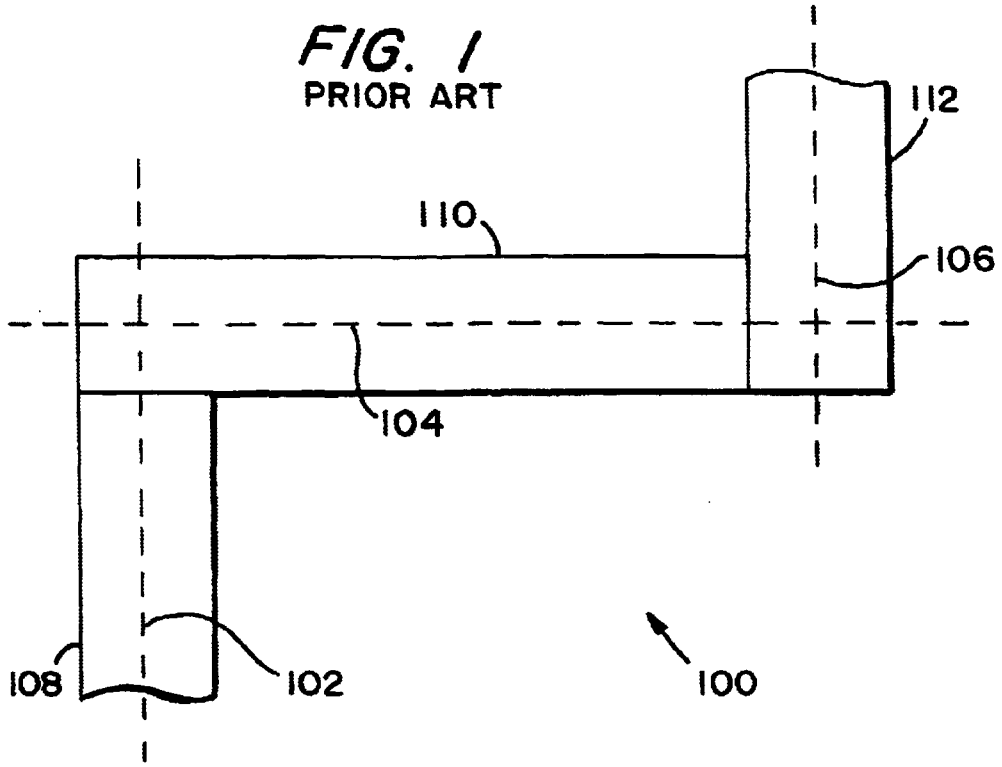
FIG. 1 PRIOR ART
FIG. 1 is a plan view of corner connections between one type of known structural wall panels.

FIG. 1 shows a known building system 100 that includes generally rectangular structural wall panels, as described above. Central alignment planes 102, 104, and 106 do not meet where wall panels 108, 110, and 112 meet. Instead, central alignment planes 102 and 104 intersect beyond the intersection of the vertical edge of panel 108 and a side of panel 110, and central alignment planes 104 and 106 intersect beyond the intersection of the vertical edge of panel 110 and a side of panel 112. Accordingly, such a structure is not considered properly aligned, and the geometric order of the structure is thus not preserved. This can cause nonuniform distribution and transmission of loads and forces, and can complicate panel dimensioning and on-site assembly.

Figure 2:
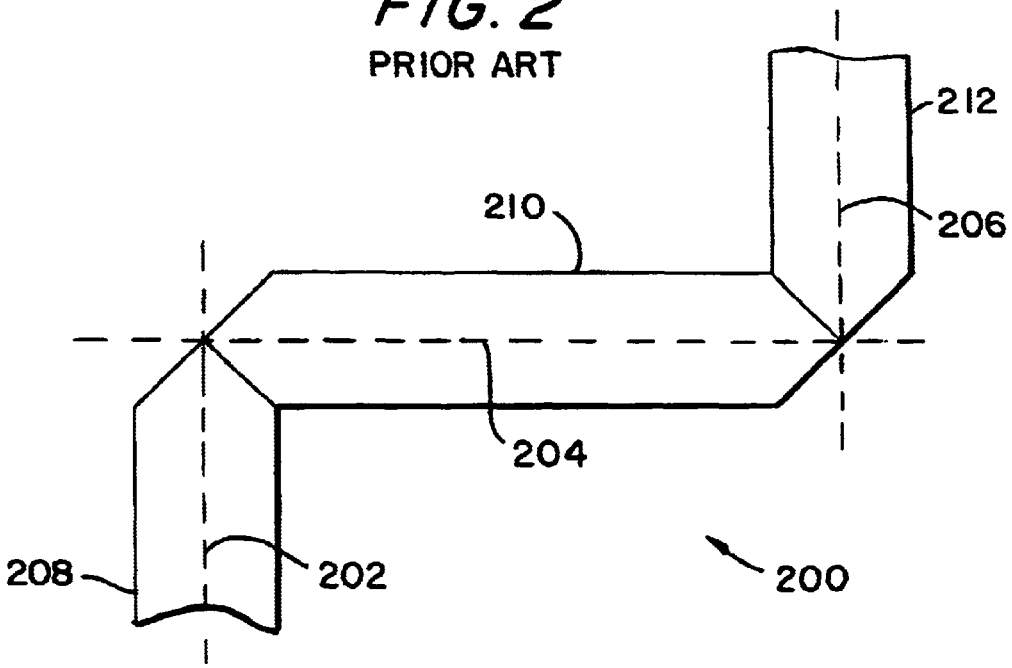
FIG. 2 PRIOR ART
FIG. 2 is a plan view of corner connections between another type of known structural wall panels.
Figure 3:
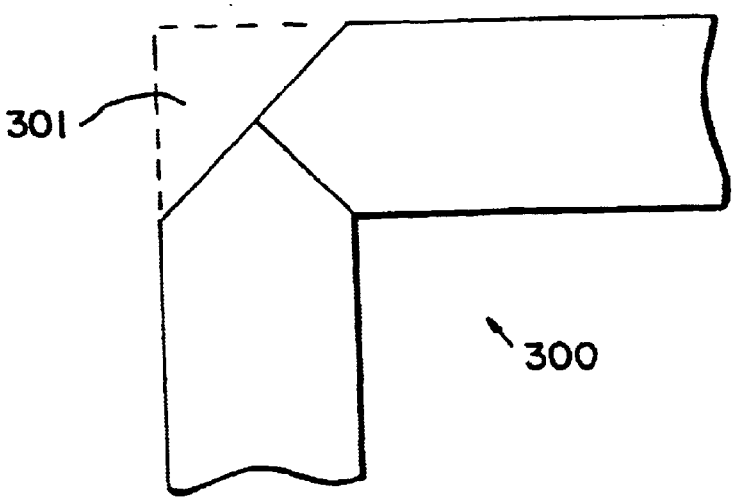
FIG. 3 PRIOR ART
FIG. 3 is a plan view of a corner connection between the panels of FIG. 2.

FIG. 2 shows another known building system 200, as also described above, that includes wall panels formed with a vertical stud having an edge that has two converging sides ending at a vertex. While this system maintains alignment of central alignment planes, as shown by the intersect-ion of alignment planes 202 and 204 at the intersection of wall panels 208 and 210, and the intersection of alignment planes 204 and 206 at the intersection of wall panels 210 and 212, the corners are incomplete. Corner section 301, as shown in FIG. 3, for example, requires additional materials and labor (and thus additional costs) to form a complete, structurally sound corner. Squaring corners formed with such panels is particularly important for structural stability and load bearing capacity in multi-level structures.

Figure 4:
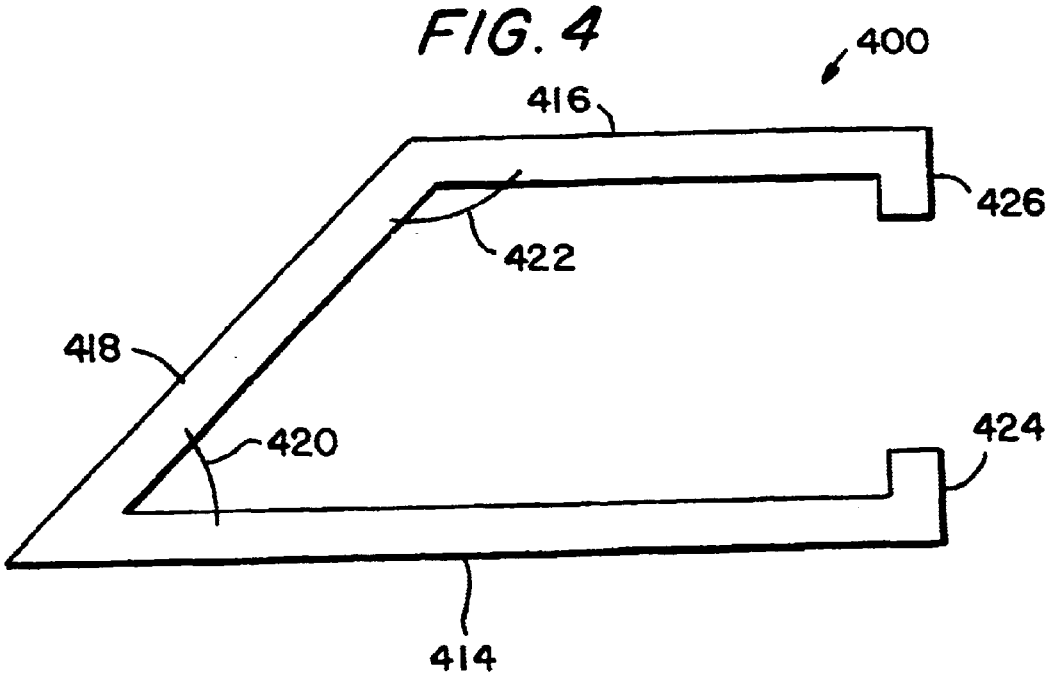
FIG. 4 is a plan view of a preferred embodiment of a corner stud in accordance with the present invention.

FIG. 4 shows a preferred embodiment of a corner stud in accordance with the present invention. Stud 400 includes preferably parallel sides 414 and 416 and a third side 418 connecting sides 414 and 416. Side 418 is preferably substantially straight, but can be accordingly dimensioned and shaped to be directly interconnected with another stud. Side 418 forms an angle 420 with side 414 and an angle 422 with side 416. The sum of angles 420 and 422 preferably equals about 180° and preferably neither angle equals 90°. Stud 400 preferably includes end segments 424 and 426, which are preferably substantially perpendicularly connected to parallel sides 414 and 416, respectively. Alternatively, end segments 424 and 426 may be connected to respective sides 414 and 416 non-perpendicularly.

Figure 5:
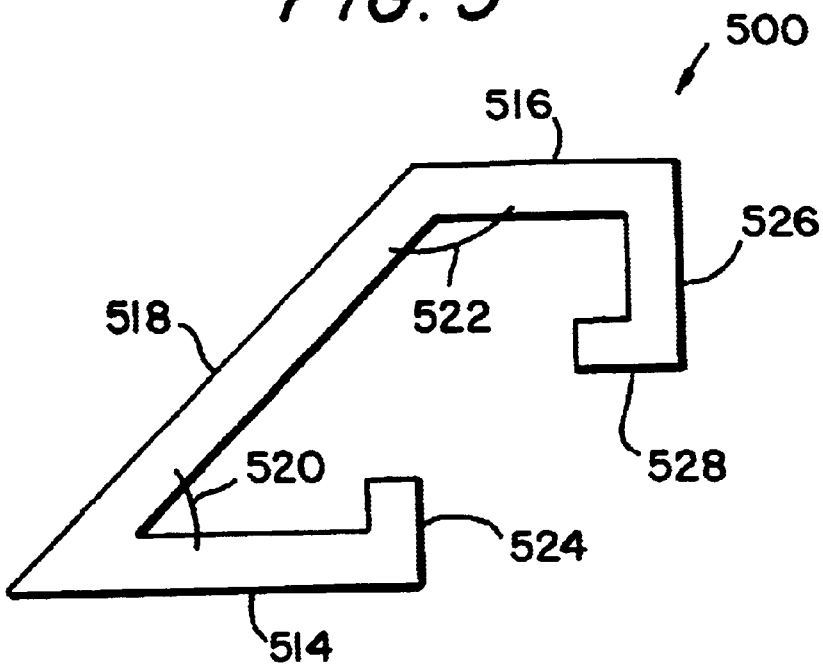
FIG. 5 is a plan view of another preferred embodiment of a corner stud in accordance with the present invention.

Advantageously, many dimensions of stud 400 (e.g., lengths and widths of sides 414, 416, and 418, and of end segments 424 and 426) can be varied relative to each other, along with the number and configuration of end lo segments, without departing from the scope and spirit of the present invention. For example, FIG. 5 shows another preferred embodiment of a corner stud in accordance with the present invention. Stud 500 includes preferably parallel sides 514 and 516, third side 518 connecting sides 514 and 516, and end segments 524 and 526 connected respectively to sides 514 and 516. Stud 500 also preferably includes end segment 528, which is preferably connected substantially perpendicularly to end segment 526. Alternatively, end segment 528 may be connected to end segment 526 non-perpendicularly. As with stud 400, the sum of angles 520 and 522 preferably equals about 180° and preferably neither angle equals 90°.

Studs 400 and 500 can each have instead of end segments (or no end segments) a fourth side connecting the ends of the parallel sides opposite the third side. Also, studs 400 and 500 each have a preferably hollow interior that can remain hollow or be filled-in with, for example, insulating or reinforcing material.

Figure 6:
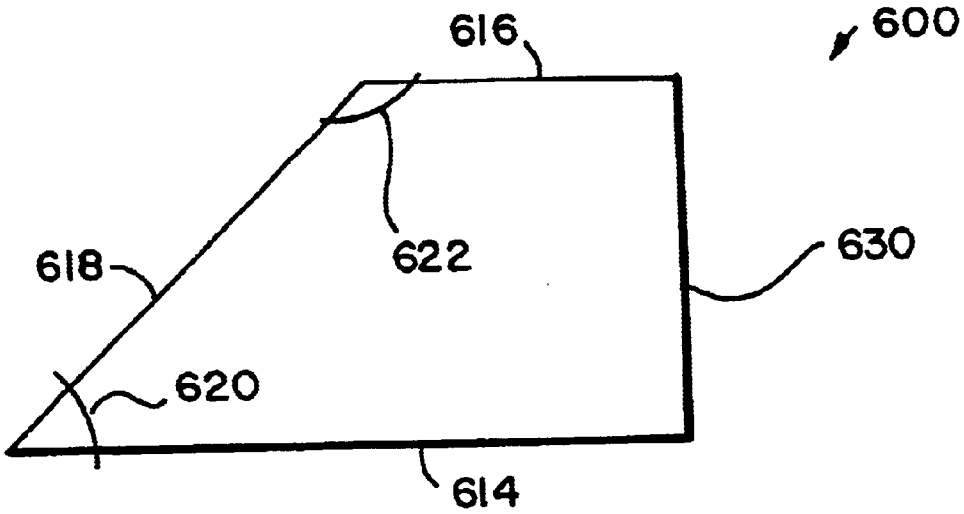
FIG. 6 is a plan view of another embodiment of a corner stud in accordance with the present invention.

Alternatively, corner studs of the present invention can have a solid interior, as shown in the corner stud embodiment of FIG. 6. Stud 600 has preferably parallel sides 614 and 616 and sides 618 and 630 connecting respective ends of sides 614 and 616. Similar to sides 418 and 518, side 618 forms angles 620 and 622 with sides 614 and 616, respectively, preferably neither angle equaling 90°. Although side 630 is shown as straight and perpendicularly connected to sides 614 and 616, side 630 can be alternatively neither.

Studs of the present invention are preferably formed from galvanized metal, stainless steel, solid wood, solid reinforced PVC, solid special plastics, waste-plastic composites, cellular fiber plastics, extruded structural components and derivatives, and any other solid materials, solid reinforced materials or hollow materials with the structural capacity and strength required for the construction of a habitable structure.

Figure 7:
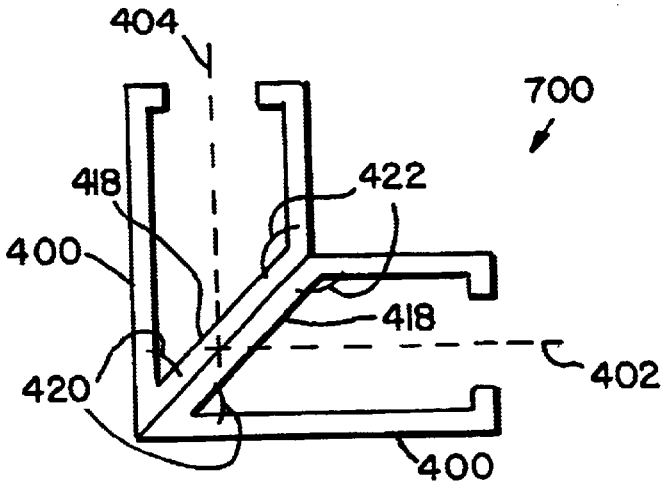
FIGS. 7–9 are plan views of corners formed with corner studs of the present invention.

Advantageously, studs of the present invention can be fabricated to form corners of various angles. For example, a substantially 90° corner can be formed with two studs 400, as shown in FIG. 7. Each stud 400 is fabricated is with angle 420 equaling about 45° and angle 422 equaling about 1350. The two studs 400 are interconnected at sides 418 to form the corner. Note that central alignment. planes 402 and 404 meet at the intersection (sides 418) of the two studs 400. Interconnected sides 418 prevent relative movement in preferably at least two directions between the studs and provide load bearing capacity for the corner.

Figure 8:
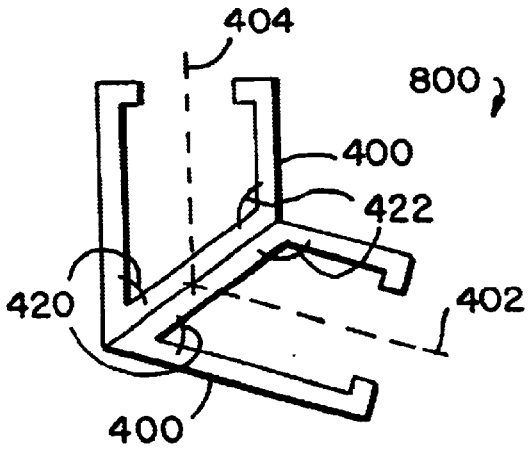
Figure 9:
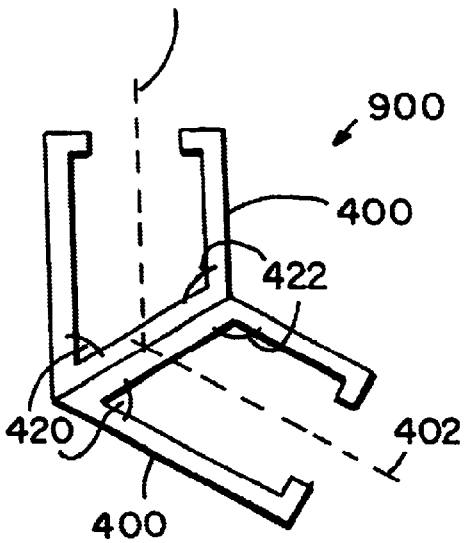
Figure 10:
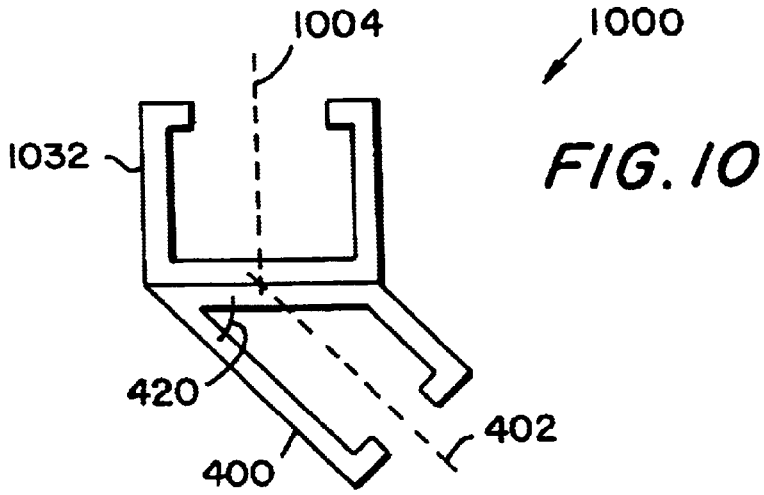
FIG. 10 is a plan view of another corner formed with a corner stud of the present invention.

Corners of other angles also can be easily formed. A substantially 108° corner (which can be used to build pentagonal structures) can be formed with two studs 400 each having angles 420 equaling about 540 and angles 422 equaling about 126°, as shown in FIG. 8. Again, central alignment planes 402 and 404 are properly aligned. To build a hexagonal structure, corners of substantially 120° can be formed with two studs 400 each having angles 420 equaling about 60° and angles 422 equaling about 120°, as shown in FIG. 9. Stud 400 can be advantageously fabricated with values of angles 420 and 422 ranging from preferably about 20° to about 85° to form corners of various angles. Moreover, stud 400 can interconnect with other types of studs or wall panels to form various corner configurations of various angles. For example, FIG. 10 shows stud 400 fabricated with angle 420 equaling about 45° interconnected with a stud 1032 to form a substantially 135° corner. Note that in both FIGS. 9 and 10, central alignment planes are properly aligned. Also note that while various embodiments of stud 400 were used in the above examples, various embodiments of studs 500 and 600 also can be fabricated to form corners of various angles.

Figure 11:
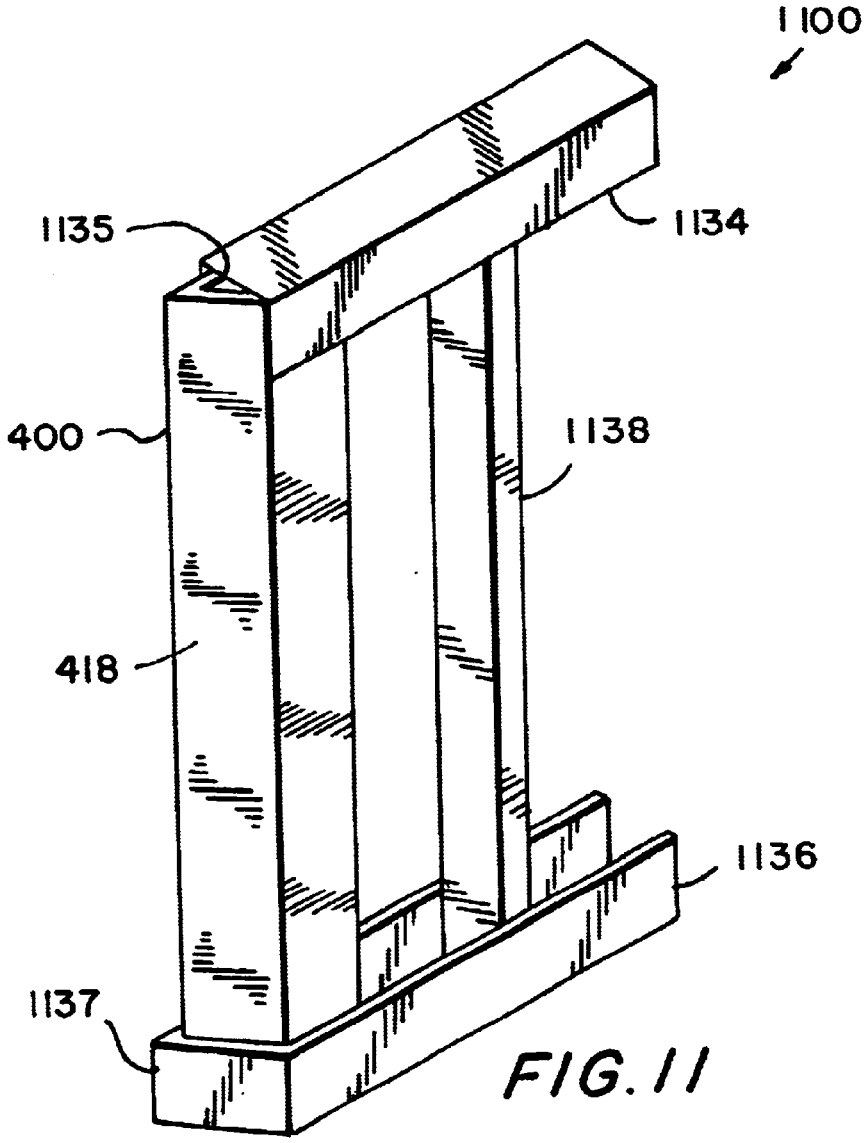
FIG. 11 is an isometric view of an exemplary embodiment of a structural wall panel in accordance with the present invention.
Figure 12:
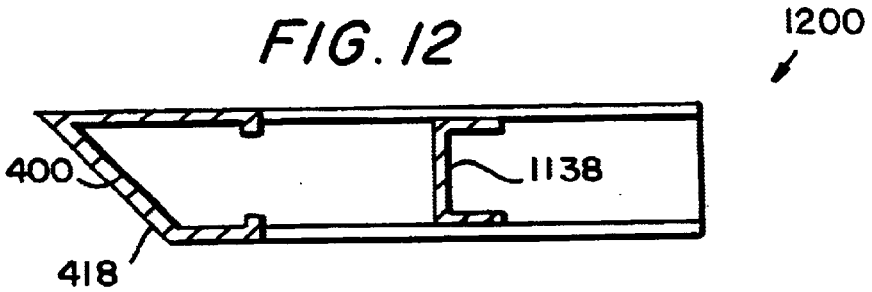
FIG. 12 is a cross-sectional plan view of the wall panel of FIG. 11.

Advantageously, studs of the present invention can be used to form structural wall panels, such as, for example, those similar to the wall panels of the prefabricated building system disclosed in the aforementioned U.S. Pat. No. 5,642,594. For example, FIGS. 11 and 12 show a wall panel 1100 incorporating stud 400 in accordance with the present invention. Panel 1100 includes upper stud 1134 and lower stud 1136 generally horizontally positioned parallel to each other. Studs 1134 and 1136 are preferably "⊔" shaped, having two parallel sides joined perpendicularly along juxtaposed free ends with a third side. Stud 400 connects upper and lower studs 1134 and 1136. Upper and lower studs 1134 and 1136 can both be open-ended, as shown by upper stud 1134 at open-end 1135, or closed-ended, as shown by lower stud 1136 at closed-end 1137. Closed-end 1137 is dimensioned and shaped to receive and preferably securely position stud 400. When necessary, depending on the length of the panel, one or more stiffener elements 1138 of any desired configuration may be used as shown. Each stiffener element 1138 is preferably aligned vertically within the panel between upper and lower studs 1134 and 1136, and is preferably generally perpendicular to at least lower stud 1136.

Figure 13:
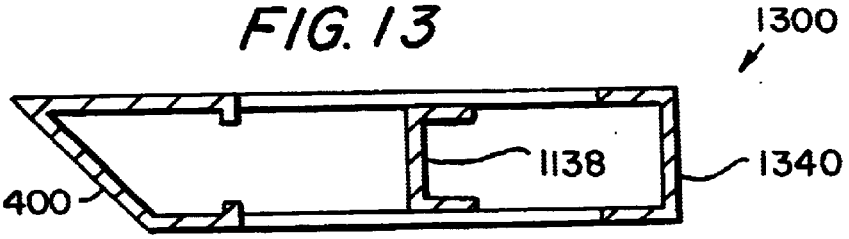
FIGS. 13–17 are cross-sectional plan views of other exemplary embodiments of structural wall panels in accordance with the present invention.

Stud 400 also preferably can be incorporated in other types of structural wall panels in accordance with the present invention, such as, for example, those shown in FIGS. 13–17. FIG. 13. shows wall panel 1300, which includes a vertical stud 1340 at an end of the panel. Vertical stud 1340 finishes the vertical edge of that end of anel 1300.

Figure 14:
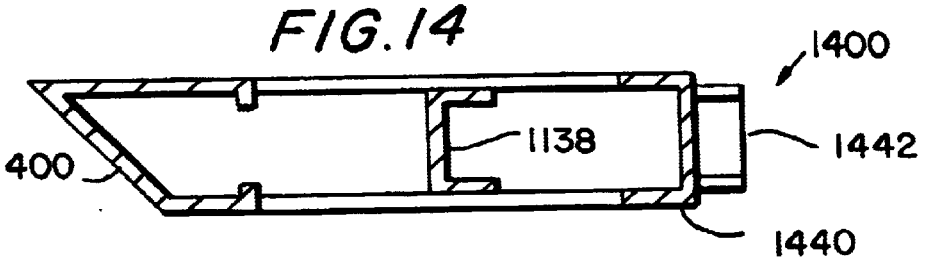

FIG. 14 shows a wall panel 1400 that includes a vertical stud 1440 having one or more male connection elements 1442 at an end of the panel. Male connection element 1442 is dimensioned and shaped such that the distance between its parallel sides is preferably slightly less than the distance between the parallel sides of upper and lower studs 1134 and 1136. This allows male connection element 1442 to fit preferably snugly into studs 1134 and 1136 (e.g., into panel 1100 at the end opposite stud 400). Male connection element 1442 preferably can have any other desired configuration that will fit into an adjoining panel or stud to provide proper interconnection.

Figure 15:
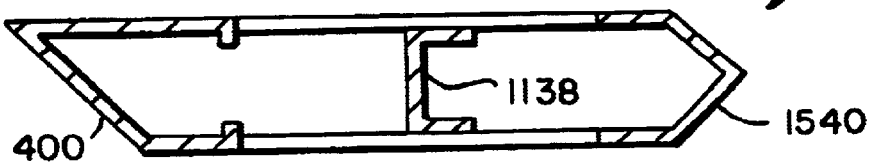

FIG. 15 shows a wall panel 1500 that includes a stud 1540 having an edge, as described above, that has two converging sides ending at a vertex. Wall panel 1500 is advantageous for forming multiple wall panel intersections, particularly 4-wall "+" intersections.

Figure 16:
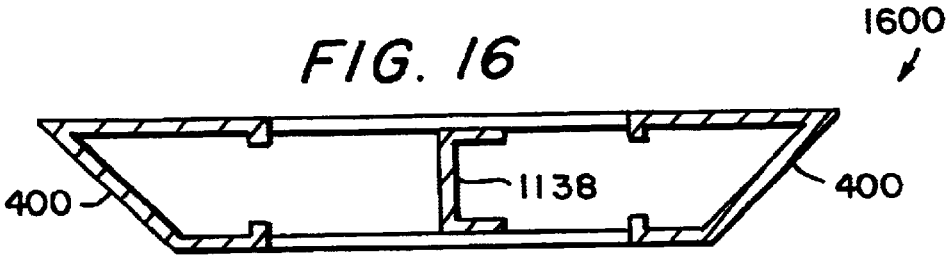
Figure 17:
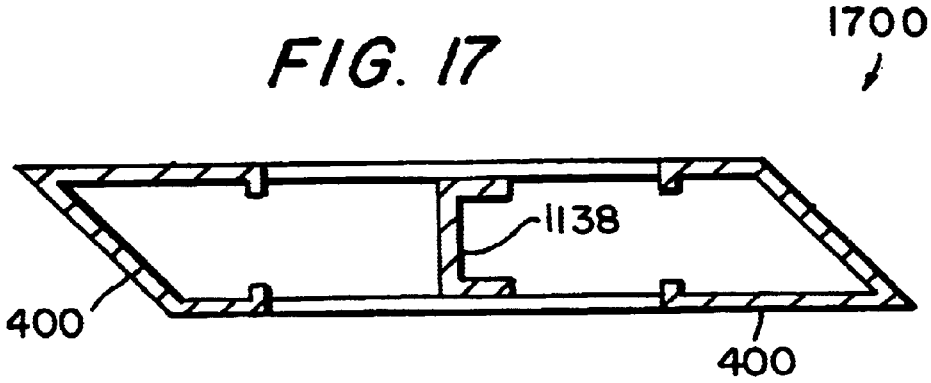

FIGS. 16 and 17 show wall panels 1600 and 1700, respectively, that each includes a stud 400 at each end of the panel. As shown, each stud 400 can have the same or opposite orientation as the other stud 400 of the panel.

Note that studs 400 having angles 420 and 422 different than those shown in FIGS. 12–17, as well as studs 500 and 600 having various angles 520, 522, 620, and 622 also can be used to construct these wall panels.

Wall panels 1100, 1300, 1400, 1500, 1600, and 1700 are preferably hollow, and may therefore be handled, transported, and installed easily by a single person. Moreover, these panels permit, when necessary, the installation of any desired insulation or acoustical material, and provide flexibility when placing electrical and plumbing lines and equipment within the panels.

Panels 1100, 1300, 1400, 1500, 1600, and 1700 can be positioned on either horizontal side, such that, for example, rather than having side 418 of stud 400 facing southwest, as shown in FIGS. 12–15, the panel can be positioned upside down to have side 418 facing northwest.

Although shown as constructed from three separate studs, wall panels 1100, 1300, 1400, 1500, 1600, and 1700 can be alternatively constructed with stud 400 and upper and lower studs 1134 and 1136 formed and assembled from a one-piece element stud, as similarly disclosed in U.S. Pat. No. 5,642, 594.

Studs of the present invention, and wall panels incorporating such studs, can be directly and easily attached to each other or to other structural components by coupling and fixing together the third side of a stud (e.g., sides 418, 518, and 618) to either another such third side or a vertical edge of another type of compatible panel or stud. Studs and panels to be joined can be welded, screwed, pinned, bolted, glued, or otherwise directly fastened to one another. This advantageously reduces costs and construction time. Furthermore, various types of connection elements formed and appropriately shaped and dimensioned on studs of the present invention, similar to those disclosed in U.S. Pat. No. 5,642, 594, for example, also can be used to connect adjoining studs and panels.

Figure 18:
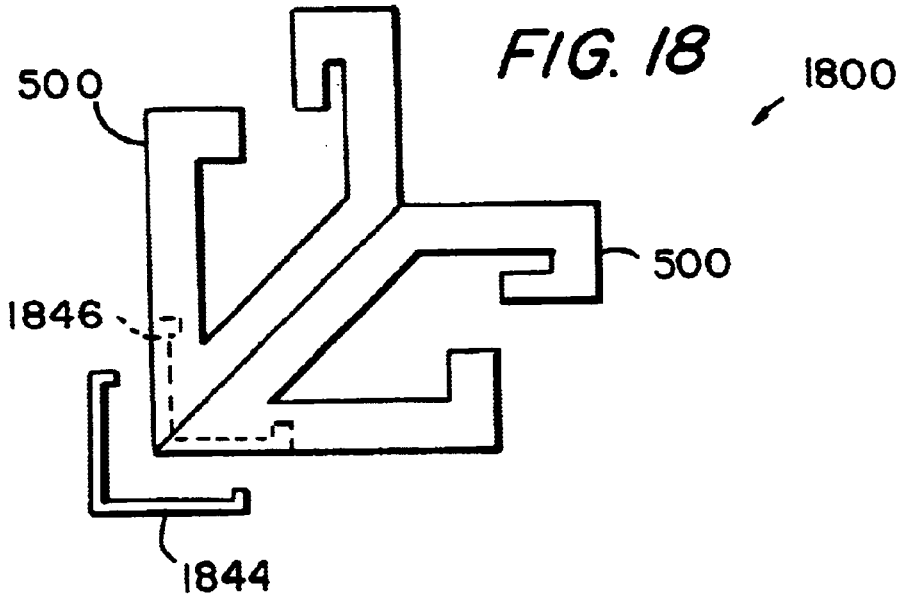
FIG. 18 is plan view of a corner formed with two studs of FIG. 5.

Further, third-piece connection elements can be alternatively or additionally used. For example, FIG. 18 shows two adjoining studs 500 connected together via one or more staple-like connection elements 1844 that fit into optional recessed receiving areas 1846 (alternatively, just receiving holes can be provided). Any desired number of elements 1844 in various arrangements (e.g., parallel or crossing over to form "X" configurations) may be used. Connection elements 1844 are preferably angled to accommodate the corner angle formed by the adjoining studs, and are preferably shaped and dimensioned for both outside (as shown) and inside corner fastening.

Figure 19:
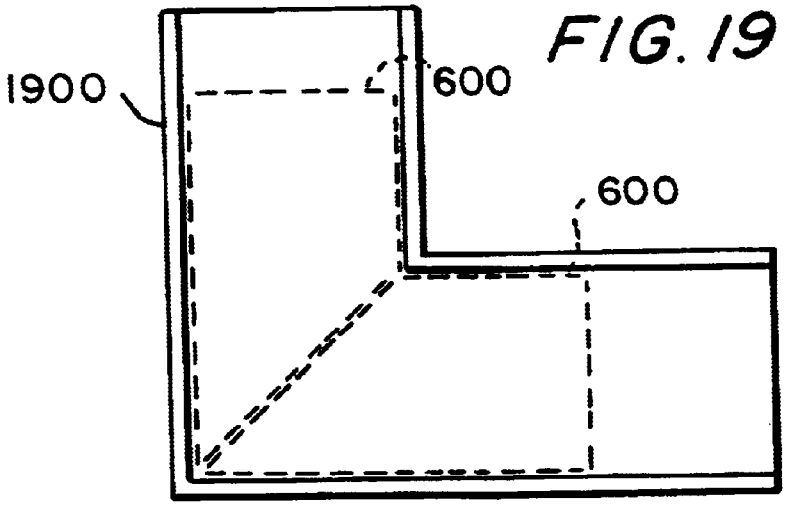
FIG. 19 is a plan view of an embodiment of a corner track in accordance with the present invention.

Alternatively or additionally, adjoining studs of the present invention, or adjoining wall panels incorporating such studs, can be positioned within a preferably single-piece corner track as shown in FIG. 19 in accordance with the present invention. Corner track 1900 is dimensioned and shaped to receive and preferably securely position a pair of adjoining studs (e.g., studs 600 shown in phantom). Corner track 1900 is angled to accommodate the corner angle formed by the adjoining studs, and preferably has a generally "⊔" shaped cross section. Adjoining studs may be secured with both an upper and lower track 1900 or, depending upon the circumstances, just an upper or just a lower track 1900.

Advantageously, studs of the present invention, and panels incorporating such studs, interconnect such that the central alignment planes meet where the vertical edges of adjoining studs and panels intersect, thus maintaining geometric order throughout the structure. Interconnections of these studs and panels therefore create a regularized structural skeleton that uniformly distributes and transmits loads and forces, and allows panel dimensions to be regularized to simplify the on-site assembly process.

Moreover, studs of the present invention are not limited to use in prefabricated building systems, but also can be used, for example, in "stick-built" structures.

Thus it is seen that easily aligned and readily interconnected corner studs are presented. One skilled in the art will appreciate that the present invention can be practiced by other than the described embodiments, which are presented for purposes of illustration and not of limitation, and the present invention is limited only by the claims which follow.

I claim:

1. A stud for a building system comprising:

first and second substantially parallel sides spaced a distance apart, each said side having a first end and a second end, said first end of said first side juxtaposed with said first end of said second side;

a pair of end segments joined substantially perpendicularly to said second ends of said first and second sides, said pair of end segments located within said spaced apart distance between said first and second sides; and a third side connecting said first ends of said first and second sides, said third side forming a first angle with said first side and a second angle with said second side, neither said angle equaling 90°, said first and second sides extending from said third side in substantially the same direction.

2. The stud of claim 1 wherein said first angle equals a value ranging from about 20° to about 85°.

3. The stud of claim 1 wherein said first angle equals about 45°.

4. The stud of claim 1 wherein said first angle equals about 60°.

5. The stud of claim 1 wherein said stud further comprises a fourth side connecting said second ends of said first and second sides, said stud having an interior bounded by said first, second, third, and fourth sides.

6. The stud of claim 5 wherein said stud interior is solid.

7. A stud for a building system comprising:

first and second substantially parallel sides spaced a distance apart, each said side having a first end and a second end, said first end of said first side juxtaposed with said first end of said second side;

a pair of end segments joined substantially perpendicularly to said second ends of said first and second sides, said pair of end segments located within said spaced apart distance between said first and second sides; and a third side connecting said first ends of said first and second sides, said third side forming a first angle with said first side and a second angle with said second side, neither said angle equaling 90°; wherein said first, second, and third sides define edges of a hollow space within said stud.

8. The stud of claim 1 wherein said third side is substantially straight.

9. A stud for a building system comprising:

first and second substantially parallel sides spaced a distance apart, each said side having a first end and a second end, said first end of said first side juxtaposed with said first end of said second side;

a pair of end segments joined substantially perpendicularly to said second ends of said first and second sides, said pair of end segments located within said spaced apart distance between said first and second sides; and a third side connecting said first ends of said first and second sides, said third side forming a first angle with said first side and a second angle with said second side, neither said angle equaling 90°; wherein said third side is dimensioned and shaped to be directly interconnected with another stud for preventing relative movement between said studs in at least two directions.

10. A structural frame corner comprising:

first and second corner studs, each stud comprising:

first and second substantially parallel sides spaced a distance apart, each said side having a first end and a second end, said first end of said first side juxtaposed with said first end of said second side, a pair of end segments joined substantially perpendicularly to said second ends of said first and second sides, said pair of end segments located within said spaced apart distance between said first and second sides, and a third side connecting said first ends of said first and second sides, said third side forming a first angle with said first side and a second angle with said second side, neither said angle equaling 90°; and a corner track dimensioned and shaped to receive said first and second studs adjoined to each other along their third sides.

11. A corner panel for a prefabricated building stem, said panel comprising:

an upper stud having a first end and a second end;

a lower stud having a first end juxtaposed with said first end of said upper stud and a second end juxtaposed with said second end of said upper stud; and a vertical stud joining said first juxtaposed ends of said upper and lower studs; wherein:

said vertical stud is dimensioned and shaped to be directly interconnected with another stud, said vertical stud having two parallel sides each having a first end juxtaposed with the other first end and a third side joining said first ends of said parallel sides, said third side forming a respective angle with each of said parallel sides, neither said angle equaling 90°, said two parallel sides each having a second end and an end segment joined substantially perpendicularly to said second end, said end segment located within a space between said first and second sides.

12. The panel of claim 11 wherein two said panels interconnected along said respective third sides of said vertical studs forms a substantially 90° corner.

13. The panel of claim 11 wherein two said panels interconnected along said respective third sides of said vertical studs forms a substantially 108° corner.

14. The panel of claim 11 wherein two said panels interconnected along said respective third sides of said vertical studs forms a substantially 120° corner.

15. The panel of claim 11 wherein at least one of said upper and lower studs comprises a "⊔" shape.

16. The panel of claim 11 wherein one of said upper and lower studs comprises a closed end dimensioned and shaped to receive said vertical stud.

17. The panel of claim 11 wherein said vertical stud has a hollow interior defined by said two parallel sides and said third side.

18. The panel of claim 11 further comprising a stiffener element vertically aligned between said upper and lower studs.

19. The panel of claim 11 wherein one of said angles equals a value ranging from about 20° to about 85°.

* * * * *